US009903336B2

(12) United States Patent
Reimann

(10) Patent No.: US 9,903,336 B2
(45) Date of Patent: Feb. 27, 2018

(54) METHOD AND DEVICE FOR IGNITING A GAS-FUEL MIXTURE

(71) Applicant: Michael Reimann, Ulm (DE)

(72) Inventor: Michael Reimann, Ulm (DE)

( * ) Notice: Subject to any disclaimer, the term of this patent is extended or adjusted under 35 U.S.C. 154(b) by 160 days.

(21) Appl. No.: 14/916,396

(22) PCT Filed: Sep. 8, 2014

(86) PCT No.: PCT/EP2014/069092
§ 371 (c)(1),
(2) Date: Jun. 14, 2016

(87) PCT Pub. No.: WO2015/032947
PCT Pub. Date: Mar. 12, 2015

(65) Prior Publication Data

US 2016/0319797 A1 Nov. 3, 2016

(30) Foreign Application Priority Data

Sep. 9, 2013 (DE) ..... 10 2013 015 063

(51) Int. Cl.
*F02P 9/00* (2006.01)
*F02P 3/04* (2006.01)
(Continued)

(52) U.S. Cl.
CPC ..... *F02P 9/007* (2013.01); *F02P 3/04* (2013.01); *F02P 3/051* (2013.01); *F02P 2017/003* (2013.01); *F02P 2017/006* (2013.01)

(58) Field of Classification Search
CPC ..... F02P 9/007; F02P 3/04; F02P 2017/006; F02P 2017/003; F02P 3/051
See application file for complete search history.

(56) References Cited

U.S. PATENT DOCUMENTS 4,287,862 A 9/1981 Noguchi et al.
4,455,989 A 6/1984 Endo et al.
(Continued)

FOREIGN PATENT DOCUMENTS

AT 507748 7/2010
DE 2810159 9/1979
(Continued)

OTHER PUBLICATIONS

"International Application No. PCT/EP2014/069092, International Search Report and Written Opinion dated Nov. 28, 2014", (dated Nov. 28, 2014), 14 pgs.

*Primary Examiner* — Hung Q Nguyen
*Assistant Examiner* — Xiao Mo
(74) *Attorney, Agent, or Firm* — Schwegman Lundberg & Woessner, P.A.

(57) ABSTRACT

The invention relates to a method and a device for igniting a gas-fuel mixture, in particular in internal combustion engines, wherein at least one gas discharge gap bounded by two electrodes is ignited by means of a high voltage, which is produced by an ignition circuit and applied to the gas discharge gap. After the breakdown of the gas discharge gap, the current through the gas discharge gap is controlled by a control circuit in such a way that the gas discharge lies in the abnormal glow range, in which the voltage across the gas discharge gap rises for currents greater than 0.1 A having a positive slope. The current through the gas discharge gap is controlled in such a way that said current lies between 0.1 A and 10 A, preferably is greater than 0.1 A and less than or equal to 3 A, more preferably lies between 0.5 A and 1 A, wherein the voltage lies between 250 V and 3000 V, preferably between 500 V and 2000 V. The duration of the current flow through the gas discharge gap or the period of the current flow through the gas discharge gap is controlled
(Continued)

in such a way that said duration or period lies between 0.01 μs and 50 μs, preferably between 0.1 μs and 10 μs.

21 Claims, 7 Drawing Sheets

(51) Int. Cl.
*F02P 3/05* (2006.01)
*F02P 17/00* (2006.01)

(56) References Cited

U.S. PATENT DOCUMENTS

| | | | | | |
|---|---|---|---|---|---|
| 4,841,925 | A * | 6/1989 | Ward | F02P 3/0884 | 123/143 B |
| 5,027,764 | A | 7/1991 | Reimann | | |
| 5,197,448 | A | 3/1993 | Porreca et al. | | |
| 5,568,801 | A * | 10/1996 | Paterson | F02P 9/007 | 123/143 B |
| 6,142,130 | A * | 11/2000 | Ward | F02P 3/005 | 123/606 |
| 2007/0176565 | A1 * | 8/2007 | Nomizo | H05B 41/2882 | 315/247 |

FOREIGN PATENT DOCUMENTS

| | | |
|---|---|---|
| DE | 102005036968 | 2/2007 |
| EP | 2554832 | 2/2013 |
| WO | WO-1995/013470 | 5/1995 |
| WO | WO-2009/106100 | 9/2009 |
| WO | WO-2015/032947 | 3/2015 |

* cited by examiner

METHOD AND DEVICE FOR IGNITING A GAS-FUEL MIXTURE

PRIORITY CLAIM TO RELATED APPLICATIONS

This application is a U.S. national stage application filed under 35 U.S.C. § 371 from International Application Serial No. PCT/EP2014/069092, which was filed 8 Sep. 2014, and published as WO2015/032947 on 12 Mar. 2015, and which claims priority to German Application No. 10 2013 015 063.9, filed 9 Sep. 2013, which applications and publication are incorporated by reference as if reproduced herein and made a part hereof in their entirety, and the benefit of priority of each of which is claimed herein.

TECHNICAL FIELD

The invention relates to a method and to a device for igniting a gas-fuel mixture, in particular in internal combustion engines, wherein at least one gas discharge gap which is delimited by two electrodes is ignited by way of a high voltage which is applied to the gas discharge gap.

BACKGROUND OF THE INVENTION

At present, high-voltage capacitor ignition and transistor coil ignition as well as magnet ignition are known for example for igniting a combustible gas-fuel mixture in the combustion chamber of an externally ignited internal combustion engine. Capacitive plasma ignition also exists as a further development of the known ignition with a discharge across the spark gap of a capacitor connected in parallel (U.S. Pat. No. 5,027,764, U.S. Pat. No. 5,197,448). These plasma ignitions display significant advantages concerning the combustion-technological and economic aspects, compared to the firstly mentioned ignitions. The charged capacitance of the capacitor which is connected in parallel to the gas discharge gap in a direct manner or decoupled by at least one high-voltage diode, is to produce a high current through the gas discharge gap after the breakdown (ionisation). The current values hereby lie at 1 to 1000 amperes. This current in the arc region of the gas discharge produces electrically charged plasma at high temperatures. Locally lean mixtures can be reliably ignited by way of this. The spark combustion duration thereby lies in the region of microseconds.

Disadvantages result due to the thermal electron emission from the hot cathode, which is common in the arc region and which results in a strong erosion of the spark plug electrodes. The gas discharge is greatly constricted with the arc discharge, by which means arc spot formation results on the surface of the cathode. The ignition energy feed is then subjected to large thermal losses, and feed losses moreover arise due to the skin effect with high frequency components, and beam loses in the light arc. A very high quantity of energy must therefore also be consumed. Technically complicated plasma spark plugs are also often necessary. Moreover, a turbulent flame propagation is produced due to this manner of introducing the ignition energy. The course of the combustion has a low flame speed and thus high consumptions and high exhaust gas values of HC and CO, and low torques, above all at a low rotation speed of the internal combustion engine. A knocking combustion can increasingly occur given high compressions.

SUMMARY

It is the object of the invention, to suggest a method and a device for igniting a gas-fuel mixture, with which the combustion is improved and a roughly laminar, rapid flame front with a high energy density is produced, wherein a glow layer of a large surface and spatial extension is produced in the gas discharge gap, and the electrode wear is kept low.

According to the invention, this object is achieved by the characterising features of the main claim in combination with the features of the preamble. Advantageous further developments and improvements are possible by way of the measures specified in the dependent claims.

According to the invention, a method for igniting a gas-fuel mixture, in particular in internal combustion engines is suggested, with which at least one gas discharge gap which is delimited by two electrodes is ignited by way of high voltage which is applied to the gas discharge gap. Due to the fact that the current through the gas discharge gap, after the breakdown of the gas discharge gap, is controlled in a manner such that the gas discharge lies in the abnormal glow region, at which the voltage across the gas discharge gap increases with a positive gradient at currents greater than 0.1 amperes, a defined plasma energy distribution in the gas discharge gap is produced, with which the excitation space of the plasma at the cathode is increased and the electrons are released from the cathode in an extensive manner, by which means a laminar flame front and a reliable flame core formation of the combustible gas fuel mixture is produced. The produced intensive laminar flame front has the characteristics of converting the mixture in a low-pollutant manner and propagating up to the wall of the combustion space. A formation of carbon deposits on the combustion chamber walls is reduced by way of this, which is to say the combustion chamber walls covered with deposits are fired away.

A reliable, time-precise and knocking-free combustion can be initiated with the method according to the invention, with which the gas discharge across the gas discharge gap lies in the abnormal glow region, even under difficult ignition conditions, such as with a high dilution of the mixture, with a high residual share which is to say lean mixtures and high charging currents. This under certain operating conditions, e.g. with regard to the load point/torque and speed of the internal combustion engine, leads to an increased operating window, e.g. with regard to the mixture ratio, and to a high efficiency which manifests itself in a higher power, improved fuel consumption and improved exhaust values. This in particular relates to the exhaust gas components of uncombusted hydrocarbons HC, carbon monoxide CO, formaldehyde and also particle emission.

The current through the gas discharge gap is advantageously controlled or set such that it lies between 0.1 ampere and 10 ampere, preferably greater than 0.1 ampere and smaller or equal to 3 amperes, even more preferred between 0.5 ampere and 1 ampere, and the voltage lies between 250 volts and 3000 volts, preferably between 500 volts and 2000 volts. The voltage and the current through the gas discharge gap are dimensioned such that the gas discharge reliably lies in the abnormal glow region, whilst taking into account the electrode geometry, the gas mixing condition, the pressure and the electrode distance.

In the preferred embodiment example, the duration and, as the case may be, the period time of the current flow through the gas discharge gap is controlled such that it lies between 0.01 and 50 microseconds, preferably between 0.1 and 10 microseconds. It is ensured that the gas discharge does not move into the region of arc discharge by way of this measure.

The amplitude and/or the shape of the current flowing through the gas discharge gap is advantageously controlled or set such that it pulse-like and/or rising and/or falling. Thereby, it can be configured for example in a ramp-like manner or saw-tooth-like manner or as d.c. components superimposed with alternating components. The optimal point for the production of the laminar flame can be run through or reached for example by way of controlling or setting the shape of the current flowing through the gas discharge gap. This can be achieved for example by way of a ramp-like current. A "pendulating" of the current through the gas discharge gap is also possible, e.g. in the form of a saw-tooth, a sine curve superimposed on a d.c. voltage, or likewise, in order to increase the possibilities of the occurrence of a laminar flame.

In a particularly preferred embodiment example, an additional current is led to the gas discharge gap, in a manner depending on the breakdown of the gas discharge gap which is detected by a sensor or which is set by the motor control. The shape of the course of the current can be better controlled in accordance with the desired settings by way of this. The additional current is thereby produced by a controlled transformer or by a controlled current source.

In a further embodiment example, the current through the gas discharge gap and initiated by the high voltage is controlled or set. This is effected in a simple manner by way of dimensioning and controlling the circuit producing the high voltage, by which means the switching effort is reduced.

According to the invention, a device for igniting a gas-fuel mixture, in particular of an internal combustion engine is likewise suggested and this is suitable for carrying out the method according to the invention with the specified features, and comprises at least one gas discharge gap which is delimited by two electrodes, an ignition circuit with an ignition transformer and providing a high voltage, and a control circuit for a control of a current flowing across the gas discharge gap, wherein the control circuit is configured to control the current in a manner such that the gas discharge across the gas discharge gap lies in the abnormal glow region, at which the voltage across the gas discharge gap increases with a positive gradient given currents of greater than 0.1 amperes The advantages mentioned with regard to the method can also be achieved when using the device according to the invention. The ignition circuit can be configured as a known ignition circuit, e.g. as a high-voltage capacitor ignition, transistor coil ignition or magnet ignition.

It is particularly advantageous that at least the cathode of a spark plug comprising the electrodes consists of a ferromagnetic material, since the spark volume between the electrodes is increased with this material, which arises from the increase of the skin effect (current displacement effect). A smaller electrode exit work is additionally given. Thereby the Curie temperature of the ferromagnetic material should not be exceeded for maintaining the spark volume increased by the skin effect, since otherwise the ferromagnetic characteristics would then change.

Moreover, it is advantageous to use a cold spark plug (i.e. with a heat rating, by way of which the surface temperature of the insulating ceramic is lower given the same operating conditions), since this has a lower infrared emission and the contamination with the clean combustion is lower.

Moreover, it is advantageous that due to the abnormal glowing combustion of a cathode of the spark plug which in particular is manufactured of steel, a procedure termed plasma nitriding occurs, with which nitrogen atoms diffuse into the surface of the electrode, by which means a nitride layer with a very hard surface arises. The spark erosion of the electrode is significantly reduced by way of this. The anode thereby can be manufactured of a noble metal or its alloys, e.g. iridium, in order to protect it from erosion. If the current flowing through the glow discharge gap is an alternating current or a polarity change occurs with each ignition cycle, then one can succeed in the plasma nitriding being achieved on both electrodes of the spark plug and both electrodes being hardened, by way of the polarity change.

According to the invention, the control circuit comprises a current source and preferably pulse-forming elements. The desired current can be controlled or set in its amplitude and/or its signal shape such that the operating point of abnormal glow discharge is reached by way of this.

In a particularly preferred embodiment example, the control circuit as a current source comprises a transformer which on the primary side is connected to a voltage source and to an driving circuit, wherein the driving circuit is configured to initiate a flow of current through the primary winding and to disconnect the primary side when the current through the primary winding exceeds a predefined threshold value or when a defined time duration has past. The driving circuit can thereby comprise a switching transistor and a threshold value detector for the current through the primary winding of the transformer and/or a time circuit, which drives the switching transistor The time circuit can thereby be configured as a monostable flip-flop (monoflop) or as a timer or as a microprocessor.

In a particularly preferred embodiment, the transformer is provided additionally to the ignition transformer of the ignition circuit. An additional current can be applied to the gas discharge gap in this manner, and the parameters of this current can be set in a simple manner by way of the additional transformer with its respective driving circuit. Thereby, the additional transformer in its dimensioning can be kept smaller than the ignition transformer necessary for producing the high voltage.

In a further embodiment example, the ignition transformer for producing the high voltage simultaneously forms the transformer for producing the current through the gas discharge gap, wherein the driving circuit must be adapted accordingly. This embodiment has the advantage that less components need to be used.

The transformer which simultaneously forms the ignition transformer and that for producing the current through the gas discharge gap is preferably configured with at least two primary windings, by which means the advantage results of being able to separately set the energy quantities for the two phases—the high voltage production and production of the abnormal glow region. The current pulse for reaching the operating point for the abnormal glow region can be fixed in a more precise manner by way of this. Moreover, no high voltage diodes which are prone to malfunction need to be applied. The two primary windings can also consist of part-windings with a tapping. Such a device according to the invention is moreover suitable for retrofitting and well as fitting for the first time.

A third primary winding as a sensor winding can yet also be provided in an advantageous manner, and this serves for the detection of the breakdown of the gas discharge gap and for the triggering for the production of the additional current through the gas discharge gap.

In an advantageous embodiment example, the control circuit comprises a controlled current source which activates a d.c. voltage source, a switching transistor and a pulse-shaping stage driving the switching transistor. Such an embodiment is advantageous inasmuch as the amplitude and the shape of the additional current, i.e. the current course through the gas discharge gap can be controlled or set in a simple manner.

The driving circuit can also comprise a pulse-shaping stage which activates the switching transistor of the driving circuit, in order to set or to control the shape and the amplitude of the embodiment with the transformer.

A sensor arrangement which uses at least one capacitive sensor (e.g. parallel wire/shield) can be used for scanning the voltage flank with the breakdown of the gas discharge gap, or an inductive sensor (e.g. current clamp) on the high-voltage conductor can be used for the occurring current pulse. This is useful when retrofitting.

The different embodiments of the device according to the invention are suitable for controlling or setting the current course which is necessary for the operating point of the gas discharge in the abnormal glow region, and the voltage which is entailed by this, wherein the parameters are specified in the context of the method. It is assumed that the integral of the current or the square of the current over time must be taken into account for avoiding the transition from the abnormal glow region into the arc region of the gas discharge gap.

The device according to the invention can advantageously be used for igniting a gas-fuel mixture in internal combustion engines, other heat engines, heating installations or gas combustors. Thereby, a retrofitting of existing ignition circuits can also be carried out. The device according to the invention can also be applied for different spark plugs which form the electrodes of the gas discharge gap. The device according to the invention can moreover be moulded at least partly with a mould mass for electrical insulation.

BRIEF DESCRIPTION OF THE DRAWINGS

Embodiments of the invention are represented in the following figures and are explained in more detail in the subsequent invention. There are shown in.

DETAILED DESCRIPTION

Figure 1:
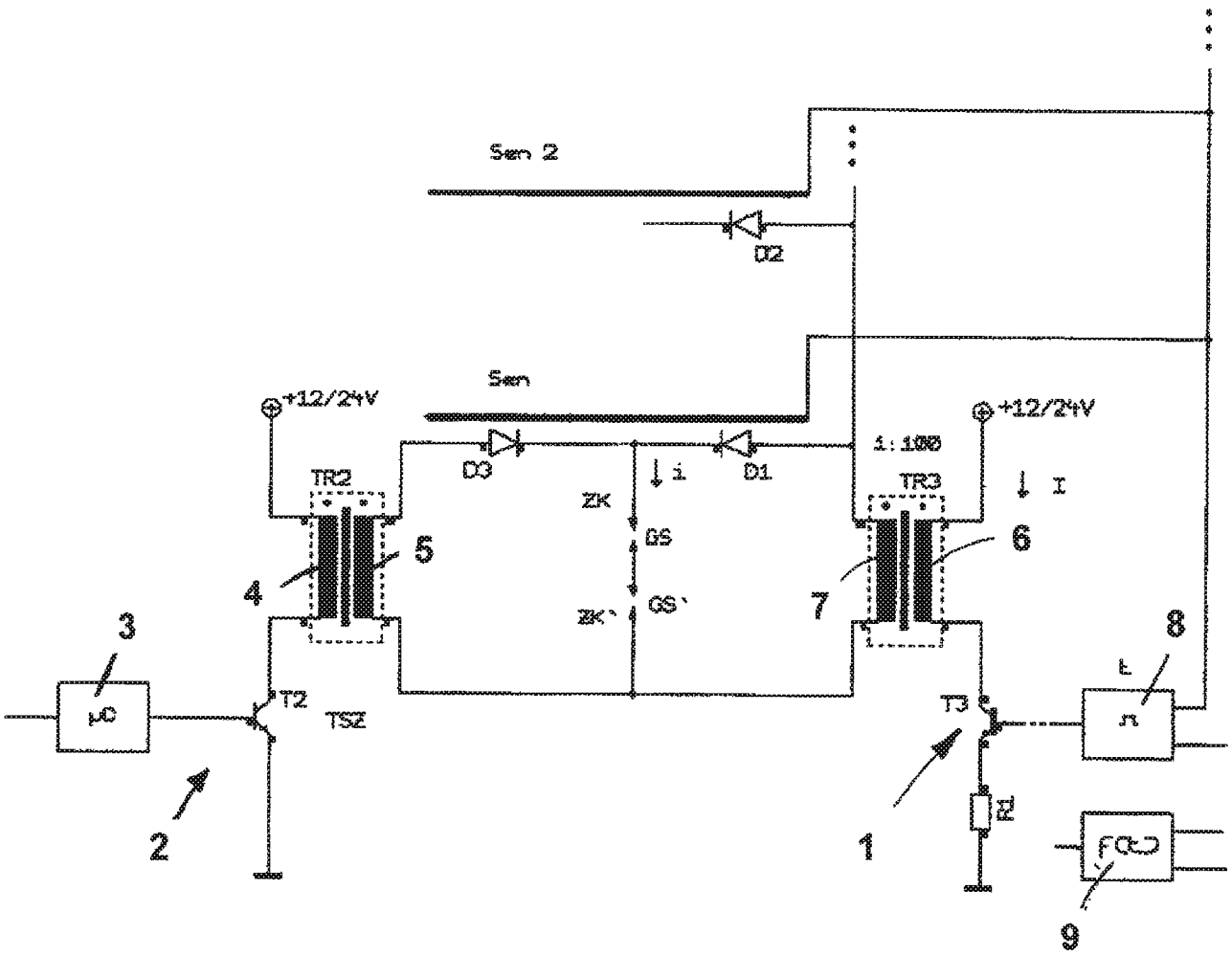
FIG. 1 a circuit diagram of the device according to the invention, according to a first embodiment example, FIG. 2 a circuit diagram of the device according to the invention, according to a second embodiment example, FIG. 3 a circuit diagram of the device according to the invention, according to a third embodiment, FIG. 4 an exemplary current-voltage characteristic curve of a gas discharge, FIG. 5 characteristics curves of the current course of the transformer used with the device according to the invention, on the primary side and the secondary side, over time, FIG. 6 a circuit diagram of the device according to the invention, according to a fourth embodiment example and FIG. 7 a circuit diagram of the device according to the invention, according to a fifth embodiment example.

The device according to the invention which is represented in FIG. 1 and which is also suitable for retrofitting, comprises an ignition circuit TSZ which is configured as a transistor coil ignition and comprises an ignition transformer TR2 as well as an driving circuit 2, wherein the driving circuit includes a transistor T2 and a microcomputer 3 which controls the transistor T2 in a manner known per se, for the production of the high voltage necessary for the ignition. The transistor T2 is connected with its collector to the primary winding 4 which moreover lies at a voltage source, e.g. the battery of a vehicle. The secondary winding 5 of the transformer TR2 is connected to two spark plugs ZK, ZK' with the associated gas discharge gaps GS and GS', i.e. a dual spark ignition installation is represented, which however is only an example. The two spark plugs ZK and ZK' can also be replaced by only one, and only one spark plug and gas discharge gap is referred to in the following description.

A high-voltage diode D3 is connected into the branch to the spark plug ZK, for preventing a back-current. The ignition transformer TR2 in the known manner and after switching off a primary current flowing through the transistor T2 through the primary winding 4, provides a high voltage to the secondary side, and accordingly a high voltage to the spark plug ZK at the point in time of the ignition.

The secondary side of a further transformer or matching transformer TR3 serving as an energy store which is separate from the ignition transformer TR2, is connected to the gas discharge gap via a high-voltage diode D1 for decoupling or blocking off the high voltage from the ignition transformer. The primary side or the primary winding 6 of the transformer TR3 with the one side is applied to the operating voltage, i.e. the battery of a motor vehicle, and the other terminal is connected to the collector of a switching transistor T3, whose emitter is applied to earth via a resistor R1. The base of the transistor T3 is connected to a monoflop 8, wherein the transistor T3 and the monoflop 8 are a constituent of the driving circuit 1. A sensor Sen which can be coupled on one side of the transformer TR2 or of the transformer TR3 to the respective lead and can be configured as a capacitive sensor, inductive sensor or as a voltage divider, serves for the detection of the breakdown of the gas discharge gap.

Further cylinders or gas discharge gaps which are decoupled by a high-voltage diode D2 are indicated in FIG. 1. However, a stage consisting of the transformer TR3 and driving circuit 1 or switching transistor T3 can also be provided for each cylinder.

The manner of functioning of the device according to FIG. 1 is explained in more detail hereinafter. The ignition circuit TSZ firstly produces a high voltage of about 10 to 30 kV and leads this to the spark plug ZK. A breakdown of the gas discharge gap GS is effected due to this. An input of the monoflop 8 driving the transistor is set via the sensor Sen which for example can be an antenna sensor and lies in the proximity of the ignition lead and detects the breakdown of the gas discharge path, since the output of the monoflop is switched to HIGH. The triggering of the monoflop 8 can also be effected via a further input by way of the motor control. The transistor T3 becomes conducting and an increasing current I shown at the top in FIG. 5, flows through the primary winding of the transformer/matching transformer TR3. The ferrite core of the transformer TR3 having a transmission ration of 1:100 for example and whose secondary winding 7 e.g. has a small inductance of about 15 mH, is charged with magnetic energy. The output is switched to LOW after completion of the charging time of the monostable flip-flop 8, by which means the transistor T3 blocks again. The switch-off criterion can also be set by a current threshold measurement at the resistor R1. The driving time of the transistor T3 is dimensioned such that a current I of about 50 to 100 A (in FIG. 5 it is 50 A) is achieved on the primary side. A current i of approx 0.5 to 1 A flows into the pre-ionised gas discharge gap GS, in the case of a transformer TR3 transformed by 1:100 for example, since the current flow at the primary side in the transformer TR3 was interrupted, i.e. the charged magnetic energy in the matching transformer TR3 is released via the high-voltage diode D1, and, as the case may be, via other components, e.g. an interference suppression filter, in the form a current across the gas discharge gap.

Figure 4:
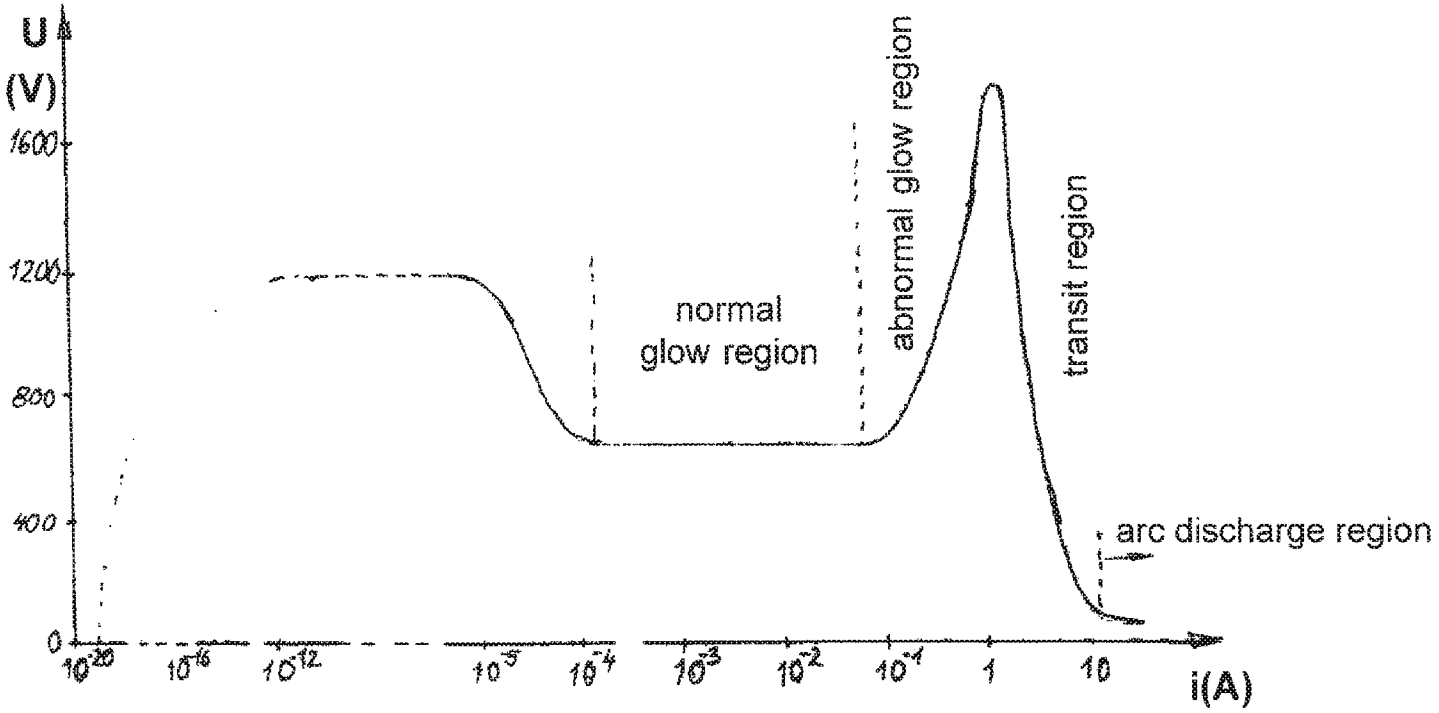
Figure 5:
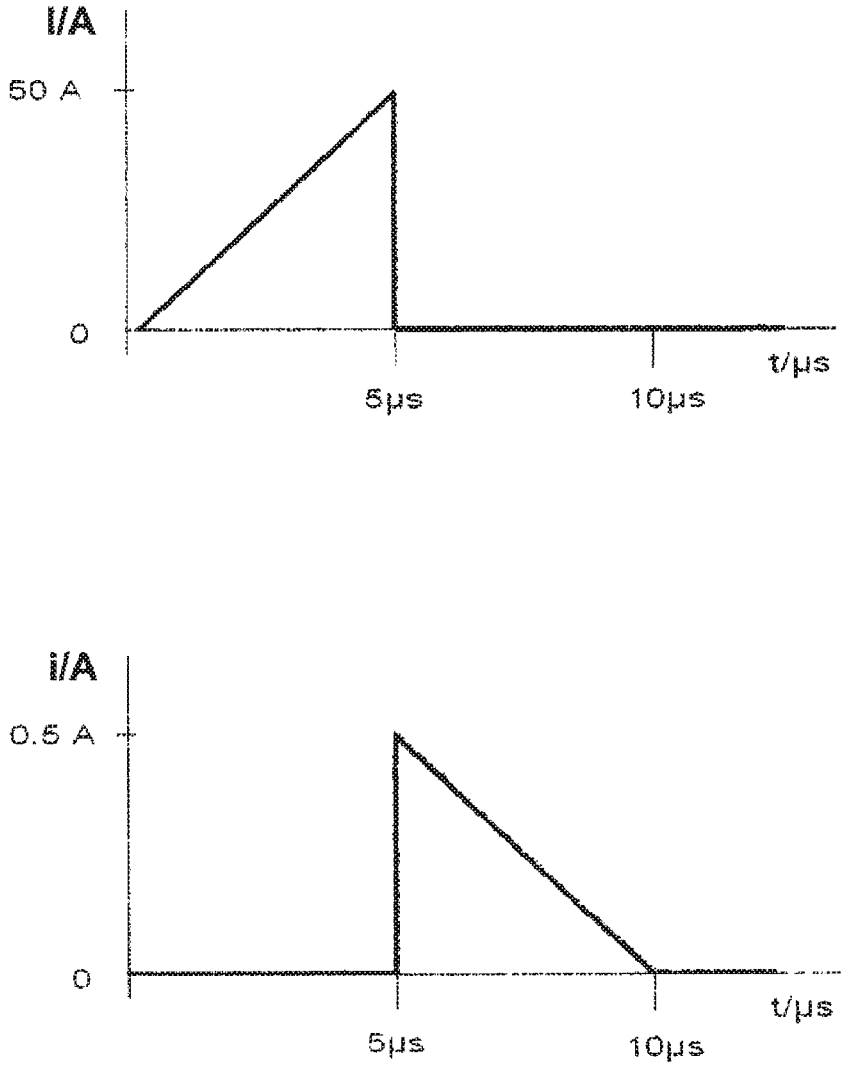

As is to be recognised from FIG. 5, the secondary current of the transformer TR3 flows over a time period of about 5 μs. Of course, other times between 0.1 and 10 μs to 50 μs can also be set. The discharge takes place in the region of abnormal glow discharge due to the supplied current i, wherein the characteristic curve of the gas discharge is represented in FIG. 4. The voltage then lies roughly in the region of 1 kV, wherein the voltage regions can lie between 250 V and 3000 V, preferably between 500 V and 2000 V depending on the design of the parameters of the components.

The maximal current on the primary side and thus also on the secondary side of the matching transformer TR3 can be determined with the switch-on time of the monostable flip-flop 8, wherein the energy to be released is also dependent on the maximal value of the charging current I on the primary side. In the described case, the course shape of the current i through the gas discharge gap is determined by the transformer or matching transformer TR3, and the current amplitude by the maximal current on the primary side. The matching transformer TR3 is responsible as a control element for the course shape, and the transistor T3 and the time of the monostable flip-flop 8 for the maximal current.

A certain operating point can be achieved by way of impressing the defined current since the typical course of the U/I characteristic curve of the gas discharge gap is known. The operating point of the abnormal glow region is reliably achieved due to the descending flank of the secondary current, as is represented in FIG. 5.

A pulse-shaping stage which, instead of the monoflop 8 or additionally to this can be connected to the base of the transistor T3 is represented in FIG. 1 with the reference numeral 9. The same input signals as with the monostable flip-flop 8 are led to this pulse-shaping stage 9, and the transistor T3 is activated according to a defined and desired signal shape, depending on these signals. For example, a primary current in the shape of a saw-tooth function or also as descending or ascending individual pulses or pulse groups can be realised. A corresponding shape of the primary current of the transformer TR3 is transmitted onto the secondary side, and the secondary current is impressed upon the gas discharge gap in accordance with this shape. Such a current course for this should serve for running through the operating point of the abnormal glow discharge and thus of the laminar flame formation, several times in an ascending or descending curve, and with this serves to ensure that the initiation of the ignition is improved which is to say the ignition reliability is increased, by way of reaching the operating point several times.

The pulse-shaping stage 9 can be controlled by a microcontroller or can comprise this microcontroller, for signal shaping. The secondary current which, as specified, can contain alternating components and for example a saw-tooth curve, is rectified by a high-voltage diode D1, so that as the case may be, only a half-wave is let through. Thus a superimposed current signal flowing across the gas discharge gap results.

The transformer TR2, with regard to the dimensioning and design of the transformers TR2 and TR3 can be designed as a conventional ignition coil, i.e. as a conventional ignition transformer which provides the high-voltage which is necessary for the ignition. With regard to the transformer, a ferrite with an air gap is provided for greater magnetic energy consumption in the air gap. As specified, the transformation ratio of the windings is in the magnitude of 1:100, wherein this is a rough detail: For example a transformation ratio of 1:75 can be selected and the ratio can also be selected between the specified transformation ratios. The secondary winding in the embodiment example is about 15 mH, whereas a magnitude of about 2.7 μH with a peak current of 50 to 100 A can be selected at the primary side. The operating voltage in the embodiment example is 12 to 24 V. The transformer TR3 provides a voltage of roughly 500 to 2000 V after the breakdown of the gas discharge gap.

Figure 2:
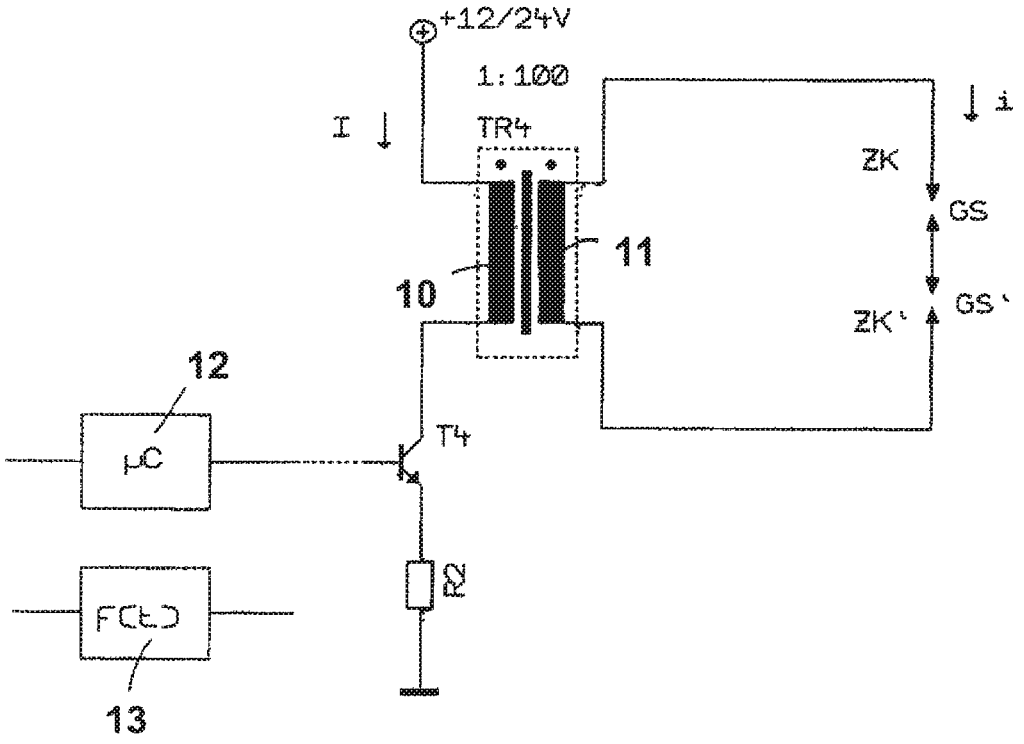

A further embodiment example of the device according to the invention is represented in FIG. 2, wherein this device above all is suitable for installation for the first time and with which the construction is similar to that according to FIG. 1 on the left side, i.e. a transformer TR4 is provided which serves the function of producing high voltage and as an energy store and implements the function of the setting or control of the current through the gas discharge gap. The primary winding 10 of the transformer TR4 again is at the operating voltage of 12 to 24 V and at the collector of a switching transistor T4, whose emitter is earthed via the resistor R2 and whose base is controlled by a microcontroller 12.

The transistor T4 is switched on by the microcontroller 12 for triggering the ignition procedure. On switching on the transistor T4, the primary side of the transformer TR4 is charged with magnetic energy by way of the increasing current I. A high voltage is supplied to the gas discharge gap GS on the secondary side of the transformer TR4 by way of switching off the transistor T4, by which means this gas discharge gap breaks down. The remaining energy of the transformer TR4, after the breakdown of the gas discharge gap, is led with a defined current course which corresponds to that in FIG. 5 and represents a decreasing ramp, into the gas discharge gap, by which means the gas discharge takes place in the region of abnormal glow discharge. For example, as represented in FIG. 5, the primary switch-off current is about 50 A, and the magnitude of the current i after the breakdown is 0.5 A as a maximum and is descending within a combustion duration of the gas discharge gap of approx. 5 μs. The current course is thereby set by the dimensioning of the transformer TR4 and its control. The components for the current i through the gas discharge gap and which determine the pulse are the transistor T4 for the maximal value, the microcontroller 12 with a defined switch-on time of the transistor T4 and the transformer TR4 with the defined transformation ratio, which here likewise lies in the range of 1:100 to 1:75. The resistor R2 just as the resistor R1 according to FIG. 1 can serve for measuring the current in the primary winding 10.

Here too, a pulse-shaping stage 13 activating the transistor T4 can be used in order to achieve a current course shape which is different to that in FIG. 5. An ascending current ramp I with a cut-off by the transistor T4 must be realised as a leading pulse on the primary side of the matching transformer TR4, so that a high voltage for the ionisation of the gas discharge gap can be formed. The pulse shaping stage 13 thereafter controls the transistor T4 in a manner such that the current course i in the gas discharge gap corresponds to an alternating signal. The use of a saw-tooth is conceivable for example, wherein firstly a high voltage for ionisation and then in each case the current pulse for the abnormal glow region are produced with multiple consecutive declining ramps. The current i is not rectified due to the fact that an additional diode is not necessary in the secondary circuit of the transformer TR4 (the high voltage and the current i of the gas discharge gap is produced from the same source TR4). An alternating current is thus possible, i.e. a "pure saw-tooth current".

Figure 3:
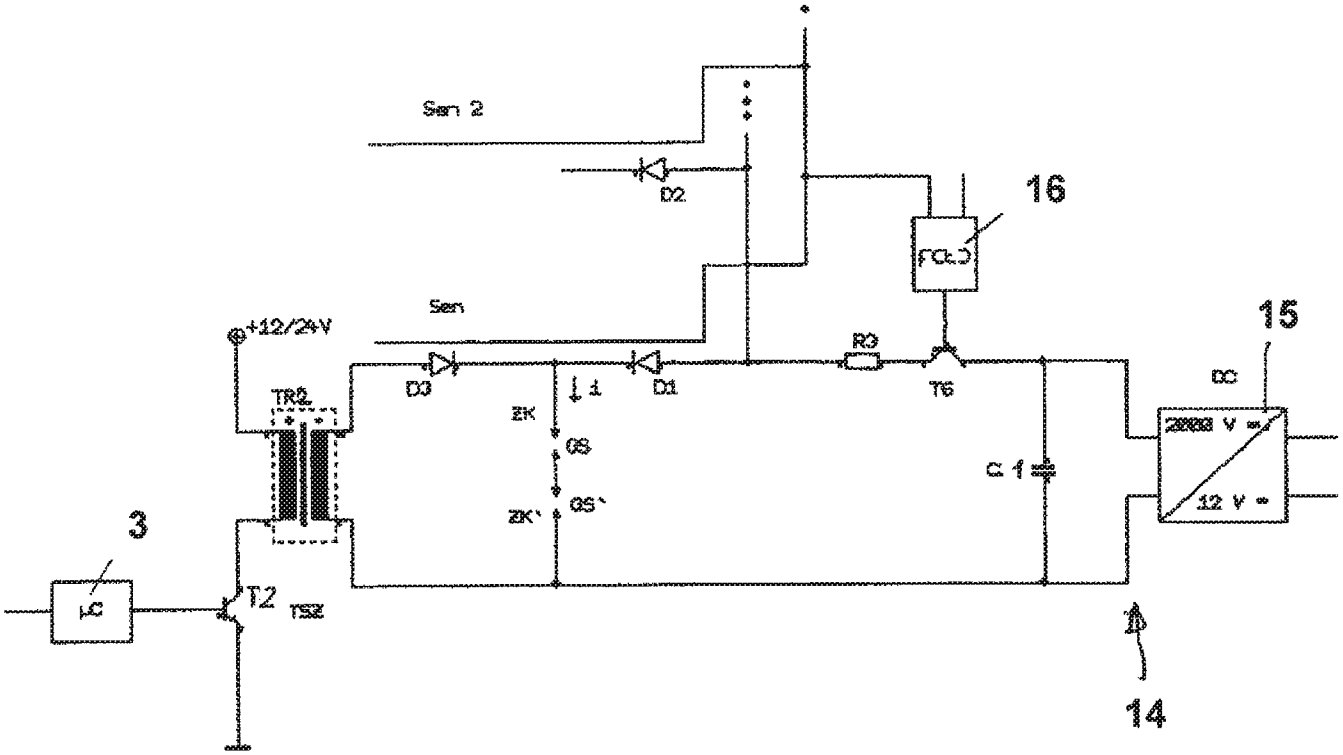

A further embodiment example with a separated energy store is represented in FIG. 3, with which the transformer TR3 with its driving 1 is replaced by a controlled current source, wherein this embodiment above all is suitable for retrofitting. The ignition circuit for producing the high voltage for the gas discharge gap corresponds to that according to FIG. 1 and is not described in more detail here.

The controlled current source comprises a d.c. voltage source 14 which here by way of example consists of a step-up chopper 15 and a capacitor C1, which for example is charged to 2000 V. The capacitor C1 is connected to the collector of a controlled switching transistor T6, whose emitter is connected via a resistor R3 and the diode D1 to the spark plug ZK for the control of the current i through the gas discharge gap after the breakdown. Here, a pulse shaping stage 16 assumes the control of the transistor T6. Here too, further gas discharge gaps which are indicated by the diode D2 and the sensor Sen2 can be controlled, in a manner corresponding to FIG. 1.

As already described in FIG. 1, an additional current through the gas discharge gap is impressed via the controlled current source, after the breakdown of the gas discharge gap. A desired curve shape of the impressed current i through the gas discharge gap can be produced by way of the controlled current source and in particular the pulse-shaping stage 16, the switching transistor T6 and the resistor R3. Thereby, the magnitude of the current and the duration of the impressing is selected according to the already known embodiment examples, i.e. for example descending current flanks of 0.1 to 1 A are produced over a time of 5 to 10 μs. As the case may be, current strengths of between 0.5 to 3 A or times between 0.5 and 50 μs can be achieved as the case may be, in the case of a somewhat different dimensioning of the components.

Figure 6:
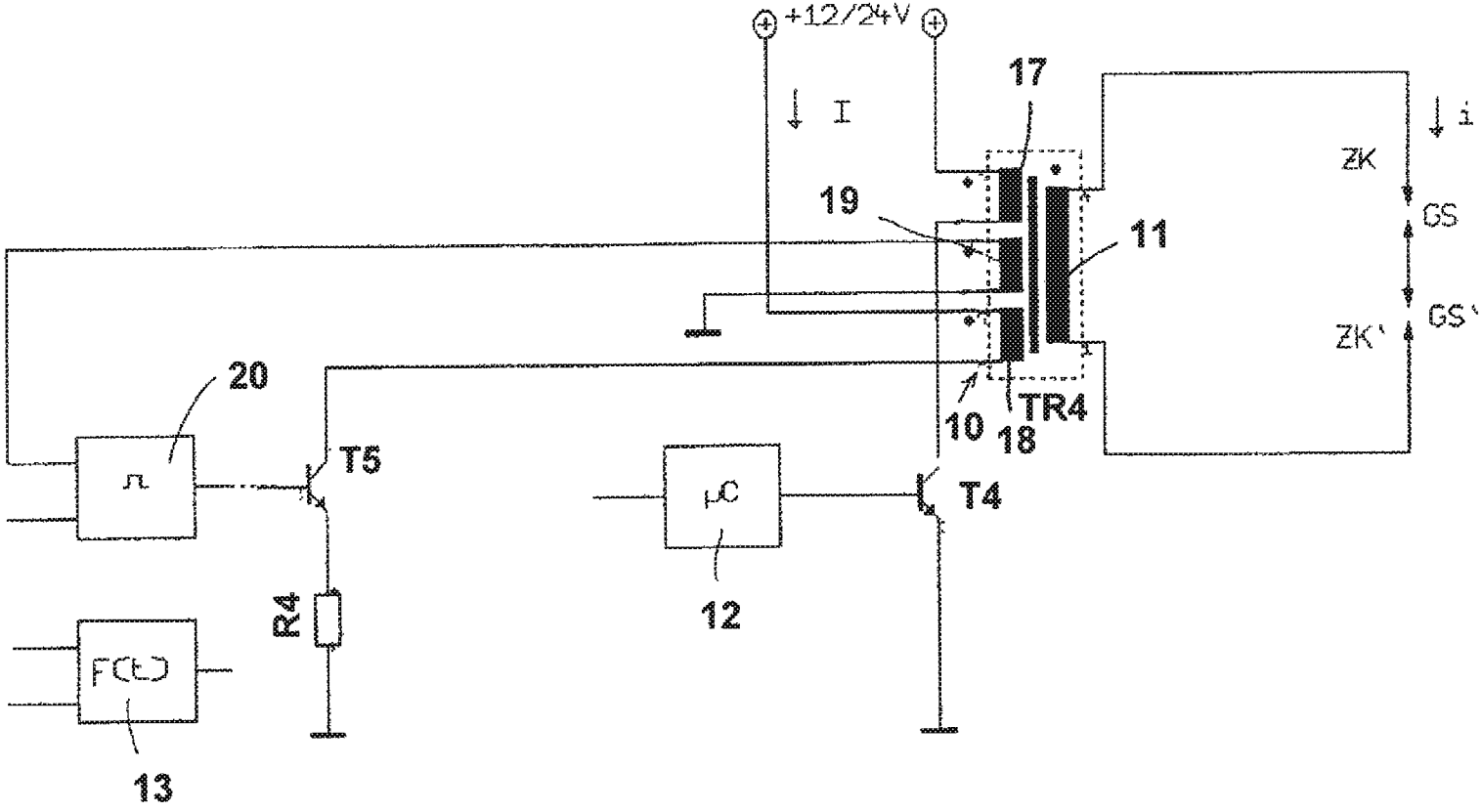

A fourth embodiment example of the invention is represented in FIG. 6, and this is suitable for retrofitting and fitting for the first time, wherein the circuit with regard to principle corresponds to that according to FIG. 2. In the present case, the primary side 10 of the transformer/matching transformer TR4 comprises two windings 17, 18 as separate energy stores for the phases of high-voltage production and medium-voltage production for the abnormal glow region, wherein the voltage which lies at the gas discharge gap when the current flows through the gas discharge gap GS at the operating point of the abnormal glow region is indicated as the medium voltage (250 to 3000 V). Both windings 17, 18 lie at the voltage supply 12/24 V. One of the windings 17 is activated by the transistor T4 which is controlled by the microcontroller 12 and the other winding 18 in the present case is activated by a transistor T5 which lies in series with a resistor R4. A third winding 19 which is indicated as a "sensor winding" is provided on the primary side 10 of the transformer TR4, which on the one hand is connected to earth and on the other hand is connected to a monostable flip-flop 20, to which again the control input of the transistor T5 is connected.

The transistor T4 is switched to being conducting via the control output of the microcontroller 12, for operation. The current through T4 increases and the associated primary winding 17 charges the transformer TR4 with magnetic energy. After reaching the greatest value of the current, the transistor T4 is switched off and a high voltage arises on the secondary side of the transformer TR4. This high voltage is led with the high-voltage lead to the gas discharge gaps GS and GS'. The gas discharge gaps GS and GS' ionise after reaching the breakdown voltage, and the voltage breaks down to a burning voltage of approx. 500 to 1000 V. The voltage flank of 15 to 40 kV which thereby occurs is transferred onto the primary-side "sensor winding" 19 in the nanosecond region and is signalled to the input of the monostable flip-flop 20 which is set. The output of the monoflop 20 switches the transistor T5 to be conductive for 5 μs. The current I through the associated primary winding 18 of the transformer TR4 increases to the maximal value of 50 A. The transistor T5 thereafter switches off gain. The current is transformed with a transformation ratio of 1:100 onto the secondary side of the transformer TR5. An initial current i of 0.5 A flows through the gas discharge gaps GS and GS'. The dropping current i ensures that the gas discharge gap is operated in the abnormal glow region.

The advantage of this circuit is the fact that the energy quantities for the two phases of high-voltage production and abnormal glow region can be fixed in a separate manner Thereby, the current pulse can be set more precisely, in order to reach the operating point for the abnormal glow region. Moreover, no high-voltage diodes which are prone to malfunction need to be applied as with the circuit according to FIG. 2.

With this embodiment too, a pulse-shaping stage 13 can be used instead of the monostable flip-flop 20, and this pulse-shaping stage 18 drives the primary winding 18 for producing the current i, wherein the manner of functioning is described in the context of FIG. 2.

Figure 7:
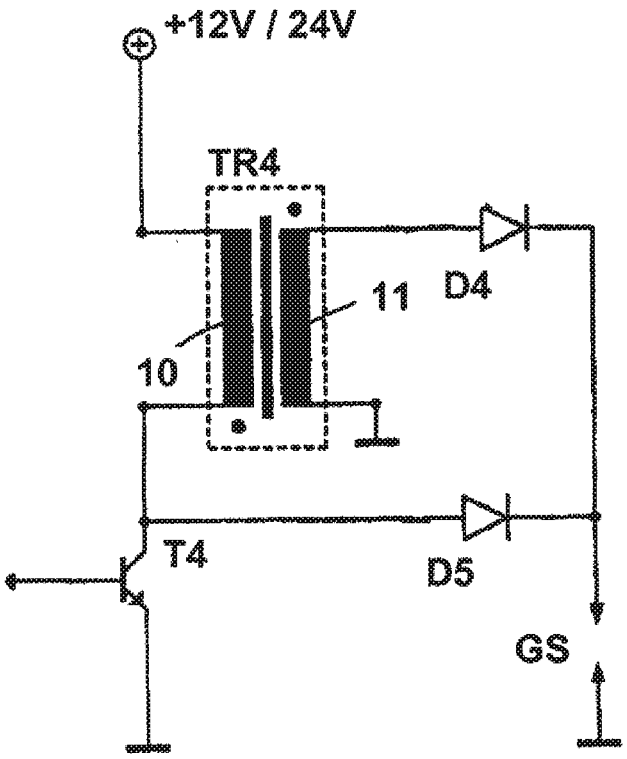

A fifth embodiment example of the invention is represented in FIG. 7, wherein this circuit too corresponds in principle to that according to FIG. 2. This circuit can be used when retrofitting or also in on fitting for the first time.

With the embodiment example according to FIG. 7, in a manner corresponding to FIG. 2, a high voltage is produced at the gas discharge gap GS after the interruption of the current in the primary winding 10 of the transformer TR4 by way of switching off the switch element or the transistor T4. After the breakdown of the gas discharge gap GS, the residual energy discharges from the primary-side winding 10 of the transformer TR4 across the gas discharge gap GS in a low-impedance manner Thereby, a discharge protection diode D4 must be arranged in the high voltage circuit for protection of shunt losses over the secondary side of the transformer TR4. The discharge protection diode D4 also serves for the protection from the reversely poled blocking voltage during the switch-on procedure of the switch element T4.

The subsequently described discharge procedure sets in after ionisation and the breakdown of the ignition voltage to the combustion voltage at the gas discharge gap GS. The current then flows out of the primary winding 10 of the transformer TR4 via a diode D5 into the gas discharge gap (the transistor T4 is blocked). The current course of this branch is then determined by the discharge of the primary winding 10 of the transformer TR4 across the gas discharge gap GS with at least two electrodes. The advantage of this circuit lies in the fact that the primary side can provide the energy for the operating point of abnormal glow discharge into the gas discharge gap GS at a high efficiency. The primary side is low-impedance.

The invention claimed is:

1. A method for igniting a gas-fuel mixture in particular in an internal combustion engine, the method comprising:

at least one gas discharge gap delimited by two electrodes ignited by way of a high-voltage applied to the gas discharge gap, wherein, after the breakdown of the gas discharge gap, the current through the gas discharge gap is controlled in a manner such that the gas discharge lies in the abnormal glow region at which the voltage across the gas discharge gap increases with a positive gradient for currents greater than 0.1 A.

2. The method according to claim 1, wherein the current through the gas discharge gap is controlled such that it lies between 0.1 A and 10 A, and the voltage lies between 250 V and 3000 V.

3. The method according to claim 1, wherein the duration of the current flow through the gas discharge gap is controlled in a manner such that it lies between 0.01 μs and 50 μs.

4. The method according to claim 1, wherein the amplitude and/or the shape of the current flowing through the gas discharge gap is a controlled in a manner such that it is pulse-shaped and/or ascending and/or descending.

5. The method according to claim 1, wherein the current initiated by the high voltage is controlled.

6. The method according to claim 1, wherein an additional current is fed to the gas discharge gap in dependence on the breakdown of the gas discharge gap which is detectable by way of a sensor or set by a motor control.

7. The method according to claim 1, wherein the additional current is produced by a controlled transformer or a controlled current source.

8. The method according to claim 1, wherein the current flowing across the gas discharge gap is ramp-like or sawtooth-like or is an alternating current or is formed as a d.c component superimposed with alternating components.

9. A device for igniting a gas-fuel mixture in particular in an internal combustion engine, the device comprising:

at least one gas discharge gap delimited by two electrodes, an ignition circuit which provides a high-voltage and an ignition transformer, and a control circuit for a control of a current flowing across the gas discharge gap, wherein the control circuit is configured to control the current in a manner such that the gas discharge across the gas discharge gap lies in the abnormal glow region, at which the voltage across the gas discharge gap increases with a positive gradient at currents greater than 0.1 A.

10. The device according to claim 9, wherein the control circuit is configured to control the current through the gas discharge gap according to the method according to claim 1.

11. The device according to claim 9, wherein the control circuit comprises a current source and pulse-shaping elements.

12. The device according to claim 9, wherein the control circuit comprises a transformer which on the primary side is provided with a voltage source and with a driving circuit and is configured to initiate a current flow through the primary winding and to switch off the primary side when the current through the primary winding exceeds a defined threshold value and/or when the defined time duration is completed.

13. The device according to claim 12, wherein the driving circuit comprises a switching transistor and a threshold value detector for the current through the primary winding or a time circuit which drives the switching transistor.

14. The device according to claim 12, wherein the transformer is provided additionally to the ignition transformer.

15. The device according to claim 12, wherein the transformer of the control circuit simultaneously forms the ignition transformer.

16. The device according to claim 15, wherein the transformer comprises at least two primary windings, of which one winding produces the high voltage for the ignition of the gas discharge gap and the other winding produces the voltage for the current flowing across the gas discharge gap after the breakdown of the gas discharge gap.

17. The device according to claim 9, wherein the control circuit comprises a controlled current source which comprises a d.c voltage source, a switching transistor and a pulse-shaping stage controlling the switching transistor.

18. The device according to claim 11, wherein the driving circuit comprises a pulse-shaping stage which controls the switching transistor.

19. The device according to claim 9, wherein a sensor arrangement for the detection of the breakdown of the gas discharge gap is provided.

20. The device according to claim 19, wherein the sensor arrangement comprises at least one capacitive or inductive sensor on the high-voltage lead or, inasmuch as the transformer of the control circuit simultaneously forms the ignition transformer, comprises an additional primary winding as a sensor winding.

21. The device according to claim 9, wherein the cathode of a spark plug comprising the electrodes consists of a ferro-electrical material.

* * * * *